US008253657B2

(12) United States Patent
Jin et al.

(10) Patent No.: US 8,253,657 B2
(45) Date of Patent: Aug. 28, 2012

(54) PLASMA DISPLAY AND MULTI-CURRENT PATH DRIVING APPARATUS THEREOF

(75) Inventors: Kyong-Pil Jin, Suwon-si (KR); Yoo-Jin Song, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 423 days.

(21) Appl. No.: 12/540,196

(22) Filed: Aug. 12, 2009

(65) Prior Publication Data

US 2010/0039420 A1 Feb. 18, 2010

(30) Foreign Application Priority Data

Aug. 13, 2008 (KR) ..... 10-2008-0079433

(51) Int. Cl.
*G09G 3/28* (2006.01)

(52) U.S. Cl. ..... 345/60; 345/63; 345/67

(58) Field of Classification Search ..... 345/60–72, 345/76, 212; 315/169.1–169.4
See application file for complete search history.

(56) References Cited

U.S. PATENT DOCUMENTS

2005/0057453 A1* 3/2005 Lee et al. ..... 345/63
2005/0231440 A1* 10/2005 Inoue et al. ..... 345/60
2006/0061523 A1* 3/2006 Kim et al. ..... 345/67

FOREIGN PATENT DOCUMENTS

| | | | |
|---|---|---|---|
| KR | 1020030013030 | A | 2/2003 |
| KR | 1020060021235 | | 3/2006 |
| KR | 1020060022601 | | 3/2006 |
| KR | 1020070048964 | A | 5/2007 |
| KR | 1020070054501 | * | 5/2007 |

* cited by examiner

*Primary Examiner* — Alexander S Beck
*Assistant Examiner* — Charles Zheng
(74) *Attorney, Agent, or Firm* — Knobbe Martens Olson & Bear LLP

(57) ABSTRACT

A driving apparatus of a plasma display is disclosed. The apparatus includes a first switch connected between a first power source for supplying a first voltage and a scan electrode, and a first diode and a second switch connected in series between a second power source for supplying a second voltage that is higher than the first voltage and the scan electrode. Further, the driving apparatus includes a third switch connected between a power recovery power source and a contact point between the first diode and the second switch, and a second diode connected in parallel the first diode and the third switch.

18 Claims, 6 Drawing Sheets

PLASMA DISPLAY AND MULTI-CURRENT PATH DRIVING APPARATUS THEREOF

CROSS-REFERENCE TO RELATED APPLICATION

This application claims priority to and the benefit of Korean Patent Application No. 10-2008-0079433 filed in the Korean Intellectual Property Office on Aug. 13, 2008, the entire contents of which are incorporated herein by reference.

BACKGROUND

1. Field

The field relates to a plasma display and a driving apparatus thereof.

2. Description of the Related Technology

A plasma display is a display device with a plasma display panel for displaying characters or images which uses plasma generated by a gas discharge. A plasma display panel includes a plurality of discharge cells arranged in a matrix format.

The plasma display is driven by dividing a frame into a plurality of subfields and displays images by the combination of weight values of the subfields that constitute the display operation among the plurality of subfields. Each subfield includes a reset period, an address period, and a sustain period. During the reset period of each subfield, cells are initialized in order to stably perform an address discharge. During the address period of each subfield, in order to select light emitting cells and non-light emitting cells, scan pulses are sequentially applied to a plurality of scan electrodes, and during a sustain period, in order to display an image, sustain pulses alternately having a high level voltage and a low level voltage are applied to the electrodes to perform sustain discharge.

When a switch for applying a voltage of the scan pulse (referred to as "scan voltage" hereinafter) in the address period is turned on, a current path may be formed to the switch for applying the scan voltage through a body diode of a switch for applying a ground voltage (e.g., 0V). A special switch is connected between the switch for applying the ground voltage and the switch for applying the scan voltage to cut off the current path. The special switch is also used to separate a negative voltage such as scan voltage and a positive voltage such as high level voltage. Thus, the special switch should be one having an threshold tolerance above the difference between the negative voltage and the positive voltage, and the cost of such a switch is high.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One aspect is a driving apparatus configured to drive a plasma display device including scan electrode. The apparatus includes a first switch connected between a first power source and the scan electrode, where the first power source is configured to supply a first voltage, and a first diode and a second switch connected in series between a second power source and the scan electrode, where the second power source is configured to supply a second voltage, the second voltage being higher than the first voltage. The apparatus also includes a third switch connected between a power recovery capacitor and a contact point between the first diode and the second switch, and a second diode connected in parallel with the first diode and the third switch.

Another aspect is a plasma display including a scan electrode, a first switch connected between a first power source and the scan electrode, where the first power source is configured to supply a scan voltage, and a sustain driver connected to the scan electrode, where the sustain driver is configured to alternately apply a low level voltage that is higher than the scan voltage and a high level voltage that is higher than the low level voltage to the scan electrode during a sustain period. The sustain driver includes a second switch having a first terminal connected to a second power source, where the second power source is configured to supply the low level voltage, a first current path between the scan electrode and a second terminal of the second switch, where the second switch is configured to cut off a current formed form the second terminal of the second switch to the scan electrode, a third switch connected between the first current path and a power recovery capacitor, where when turned on a voltage of the scan electrode is decreased through the first current path, and a second current path from the second terminal of the second switch to the scan electrode, the second current path being different from the first current path.

Another aspect is a driving apparatus configured to drive a scan electrode of a plasma display device. The apparatus includes a first switch configured to supply the scan electrode with a supply voltage through either of first and second current paths, the first current path configured to conduct current from the scan electrode and the second current path configured to conduct current to the scan electrode. The apparatus also includes a first diode in the first current path, and a second diode in the second current path.

DETAILED DESCRIPTION OF CERTAIN INVENTIVE EMBODIMENTS

Figure 1:
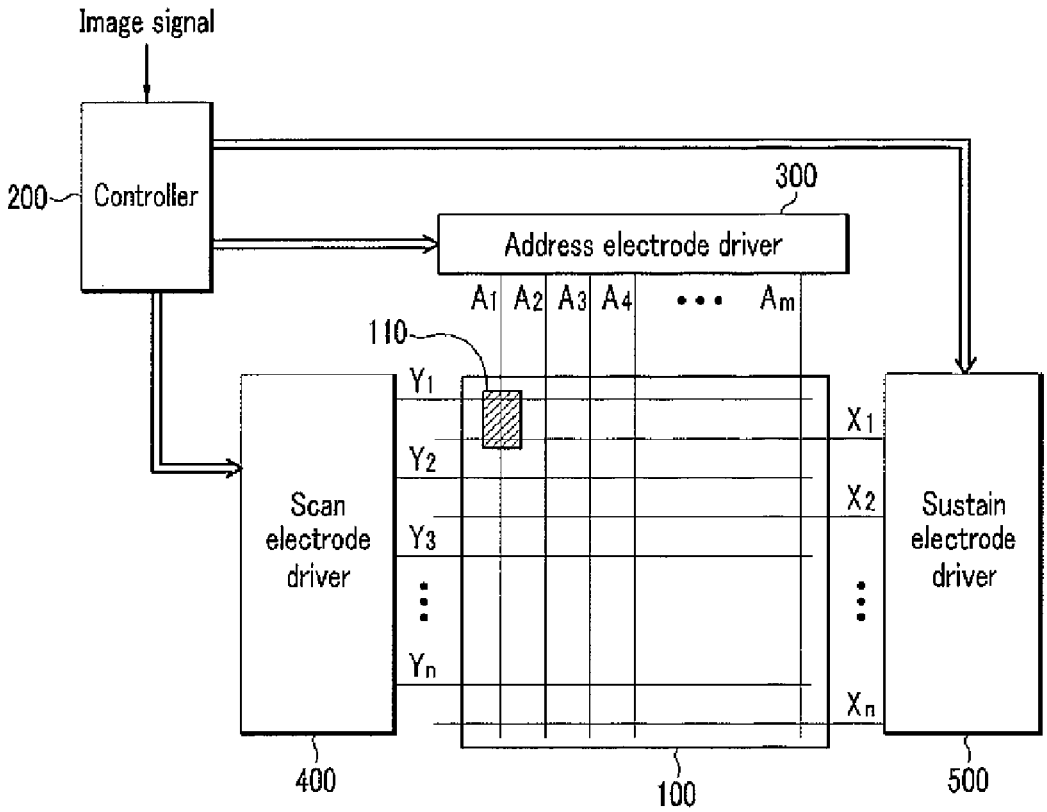
FIG. 1 is a drawing showing a plasma display device according to an exemplary embodiment.

Various embodiments include a plasma display and a driving apparatus thereof having advantages of reducing cost of the plasma display.

Some embodiments include a driving apparatus for driving a plasma display device including a scan electrode. The driving apparatus includes a first switch, a first diode, a second switch, a third switch, and a second diode. The first switch is connected between a first power source for supplying a first voltage and the scan electrode. The first diode and the second switch are connected in series between a second power source for supplying a second voltage that is higher than the first voltage and the scan electrode. The third switch is connected between a power recovery capacitor and a contact point between the first diode and the second switch, and the second diode is connected in parallel between the first diode and the third switch.

A cathode of the first diode is connected to a first terminal of the third switch, a second terminal of the third switch is connected to an anode of the second diode, and a cathode of the second diode is connected to an anode of the first diode.

Other exemplary embodiments include a plasma display including a scan electrode, a first switch, and a sustain driver. The first switch is connected between a first power source for supplying a scan voltage and the scan electrode, and the sustain driver connected to the scan electrode and alternately applies a low level voltage that is higher than the scan voltage and a high level voltage that is higher than the low level voltage to the scan electrode during a sustain period.

The sustain driver includes a second switch, a first current path, a third switch, and a second current path. The second switch has a first terminal connected to a second power source for supplying the low level voltage. The first current path is connected between the scan electrode and a second terminal of the second switch and is for cutting off a current formed from the second terminal of the second switch to the scan electrode. The third switch is connected between the first current path and a power recovery capacitor and is for decreasing a voltage of the scan electrode through the first current path when turned on, and the second current path passes a current from the second terminal of the second switch to the scan electrode.

According to some exemplary embodiments, because the plasma display uses a plurality of diodes with a low cost instead of the switch with a high cost, the cost of the plasma display can be reduced.

In this detailed description, only certain exemplary embodiments have been shown and described, simply by way of illustration. As those skilled in the art would realize, the described embodiments may be modified in various different ways, without departing from the spirit or scope of the present invention. Accordingly, the drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "indirectly coupled" to the other element through a third element.

Hereinafter, a plasma display device and a driving apparatus thereof according to exemplary embodiments will be described.

FIG. 1 is a drawing showing a plasma display device according to an exemplary embodiment.

As shown in FIG. 1, a plasma display includes a plasma display panel 100, a controller 200, an address electrode driver 300, a scan electrode driver 400, and a sustain electrode driver 500.

The plasma display panel 100 includes a plurality of address electrodes A1-Am (referred to as "A electrodes") extending in a column direction, and a plurality of sustain electrodes X1-Xn (referred to as "X electrodes") and a plurality of scan electrodes Y1-Yn (referred to as "Y electrodes") extending in a row direction, in pairs. In general, the X electrodes X1-Xn are formed to correspond to the respective Y electrodes Y1-Yn, and the X electrodes X1-Xn and the Y electrodes Y1-Yn cooperatively perform a display operation during a sustain period in order to display an image. The Y electrodes Y1-Yn and the X electrodes X1-Xn are arranged to cross the A electrodes A1-Am. Discharge spaces near the crossings of the A electrodes A1~Am and the X and Y electrodes X1~Xn and Y1~Yn form discharge cells 110. The structure of the PDP 100 shows one example, and a panel with a different structure to which driving waveforms described herein can be applied can also be applicable.

The controller 200 receives a image signal and outputs an A electrode driving control signal, an X electrode driving control signal, and a Y electrode driving control signal. Further, the controller 200 drives a frame by dividing it into a plurality of subfields each having a weight value. Each subfield includes a reset period, an address period and a sustain period.

The address electrode driver 300 receives the A electrode driving control signal from the controller 200 and applies a driving voltage to the A electrodes A1-Am.

The scan electrode driver 400 receives the Y electrode driving control signal from the controller 200 and applies a driving voltage to the Y electrodes Y1-Yn.

The sustain electrode driver 500 receives the X electrode driving control signal from the controller 200 and applies a driving voltage to the X electrodes X1-Xn.

Figure 2:
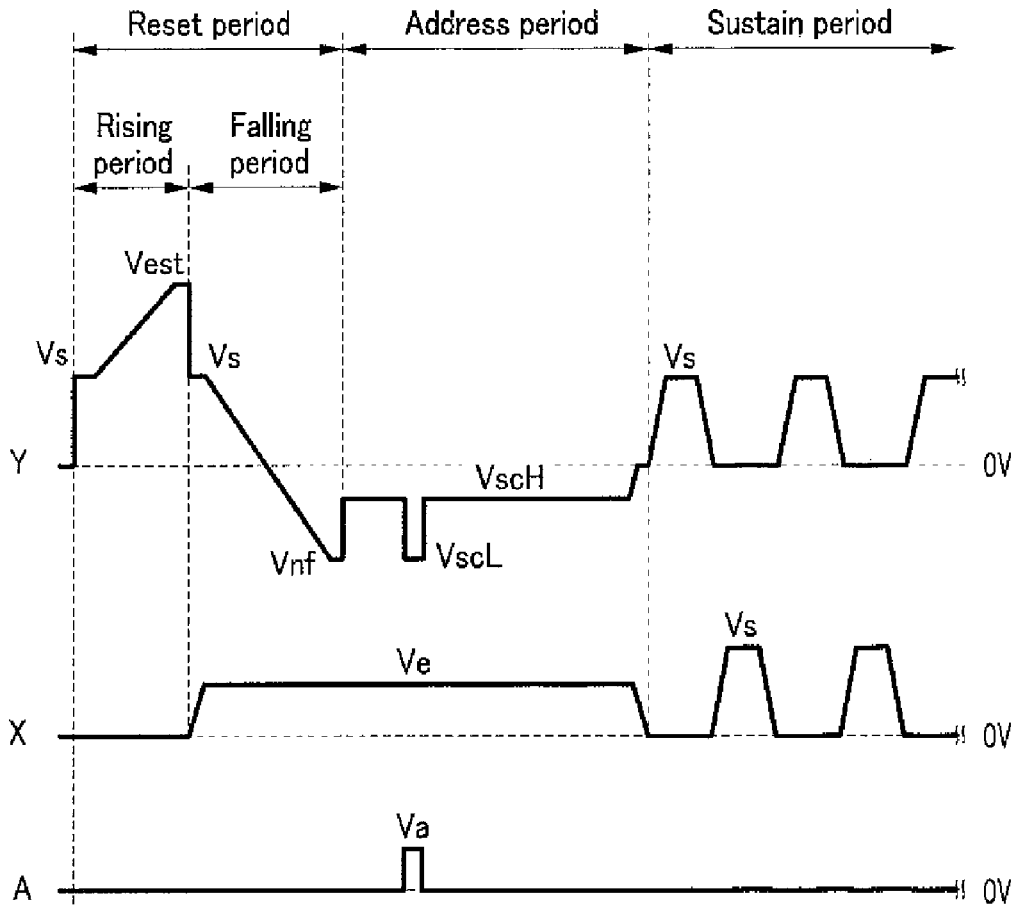
FIG. 2 is a drawing showing a driving waveform of the plasma display device according to an exemplary embodiment.

FIG. 2 is a drawing showing a driving waveform of the plasma display device according to an exemplary embodiment. FIG. 2 shows driving waveforms applied to the X electrode, the Y electrode and the Λ electrode of a single discharge cell.

As shown in FIG. 2, during a rising period of the reset period, the address electrode driver 300 and the sustain electrode driver 500 bias the voltages of the A and X electrodes to a reference voltage (e.g., 0V in FIG. 2), respectively, and the scan electrode driver 400 gradually increases the voltage of the Y electrode from a voltage Vs to a voltage Vset. In FIG. 2, the voltage of the Y electrodes is increased in a ramp pattern.

A weak discharge occurs between the Y and X electrodes and between the Y and A electrodes while the voltage of the Y electrodes is being increased. As a result, negative (−) wall charges are formed in the Y electrodes and positive (+) wall charges are formed in the X and A electrodes. FIG. 2 shows that the voltage of the Y electrode gradually increases from the voltage Vs. However, the voltage of the Y electrode may be gradually increased from a voltage different from the voltage Vs, for example a voltage (VscH−VscL) corresponding to a difference between a voltage VscH and a voltage VscL as described below.

During the falling period of the reset period, the sustain electrode driver 500 biases the voltage of the X electrodes to a voltage Ve, and the scan electrode driver 400 gradually decreases the voltage of the Y electrodes from the voltage Vs to a voltage Vnf. In the embodiment of FIG. 2, the voltage of the Y electrodes is reduced in the ramp pattern.

As a result, a weak discharge occurs between the Y and X electrodes and between the Y and A electrodes while the voltage of the Y electrodes is being decreased. Consequently, the negative (−) wall charges formed in the Y electrodes are erased and the positive (+) wall charges formed in the X and A electrodes are erased. The magnitude of the difference between the voltage Vnf and the voltage Ve (Vnf−Ve) may be close to a discharge firing voltage between the Y and X electrodes. As a result, the wall voltage between the Y and X electrodes becomes nearly 0V, to thereby prevent a misfiring discharge in a cell in which an address discharge does not occur during the address period. In addition, FIG. 2 shows that the voltage of the Y electrode gradually decreases from the voltage Vs. However, the voltage of the Y electrode may be gradually decreased from a voltage other than the voltage Vs, for example, 0V.

As shown in FIG. 2, during the address period, in order to select a light emitting cell, the sustain electrode driver 500 maintains the voltage of the X electrode to a voltage Ve, and the scan electrode driver 400 and the address electrode driver 300 apply a scan pulse having a scan voltage VscL of a negative voltage and an address pulse having an address voltage Va of a positive voltage to the Y electrode and the A electrode, respectively.

The scan electrode driver 400 applies a non-selected Y electrode with the voltage VscH of a negative voltage that is higher than the scan voltage VscL, and the address electrode driver 300 applies the A electrode of a non-light emitting cell with the reference voltage. The voltage VscL may be equal to the voltage Vnf. In some embodiments, the voltage VscL is lower than the voltage Vnf.

During the address period, the scan electrode driver 400, and the address electrode driver 300 apply scan pulses to the Y electrode (Y1 in FIG. 1) of a first row and at the same time apply address pulses to the A electrodes positioned at light emitting cells in the first row. This results in address discharges occurring between the Y electrodes (Y1 in FIG. 1) of the first row and the A electrodes to which the address pulses have been applied, forming positive (+) wall charges in the Y electrode (Y1 in FIG. 1) and negative (−) wall charges in the A and X electrodes of the discharge cells corresponding to the A and X electrodes.

Subsequently, while the scan electrode driver 400 applies scan pulses to the Y electrode (Y2 in FIG. 1) of a second row, the address electrode driver 300 applies address pulses to the A electrodes for light emitting cells of the second row. As a result, address discharges occur at cells of the A electrodes to which the address pulses have been applied and the Y electrode (Y2 in FIG. 1) of the second row, forming wall charges in the cells. Likewise, while the scan electrode driver 400 sequentially applies scan pulses to the Y electrodes of the remaining rows, the address electrode driver 300 applies address pulses to the A electrodes positioned at light emitting cells to form wall charges.

In order to select non-light emitting cells, the address electrode driver 300 may apply the voltage Va to the A electrodes of non-light emitting cells where the Y electrode receives the scan voltage VscL.

During the sustain period, the scan electrode driver 400 applies the sustain pulse alternately having a high level voltage (Vs in FIG. 2) and a low level voltage (0V in FIG. 2) to the Y electrodes a number of times corresponding to a weight value of the current subfield.

In addition, the sustain electrode driver 500 applies a sustain pulse to the X electrodes with a phase opposite to that of the sustain pulse applied to the Y electrodes. That is, in this embodiment, 0V is applied to the X electrode when a VS voltage is applied to the Y electrode, and the VS voltage is applied to the X electrode when 0V is applied to the Y electrode. In this case, the voltage difference between the Y electrode and the X electrode alternately has a Vs voltage and a −Vs voltage. Accordingly, the sustain discharge repeatedly occurs at light emitting cells as many times as the number corresponding to the weight value of the current subfield.

Figure 3:
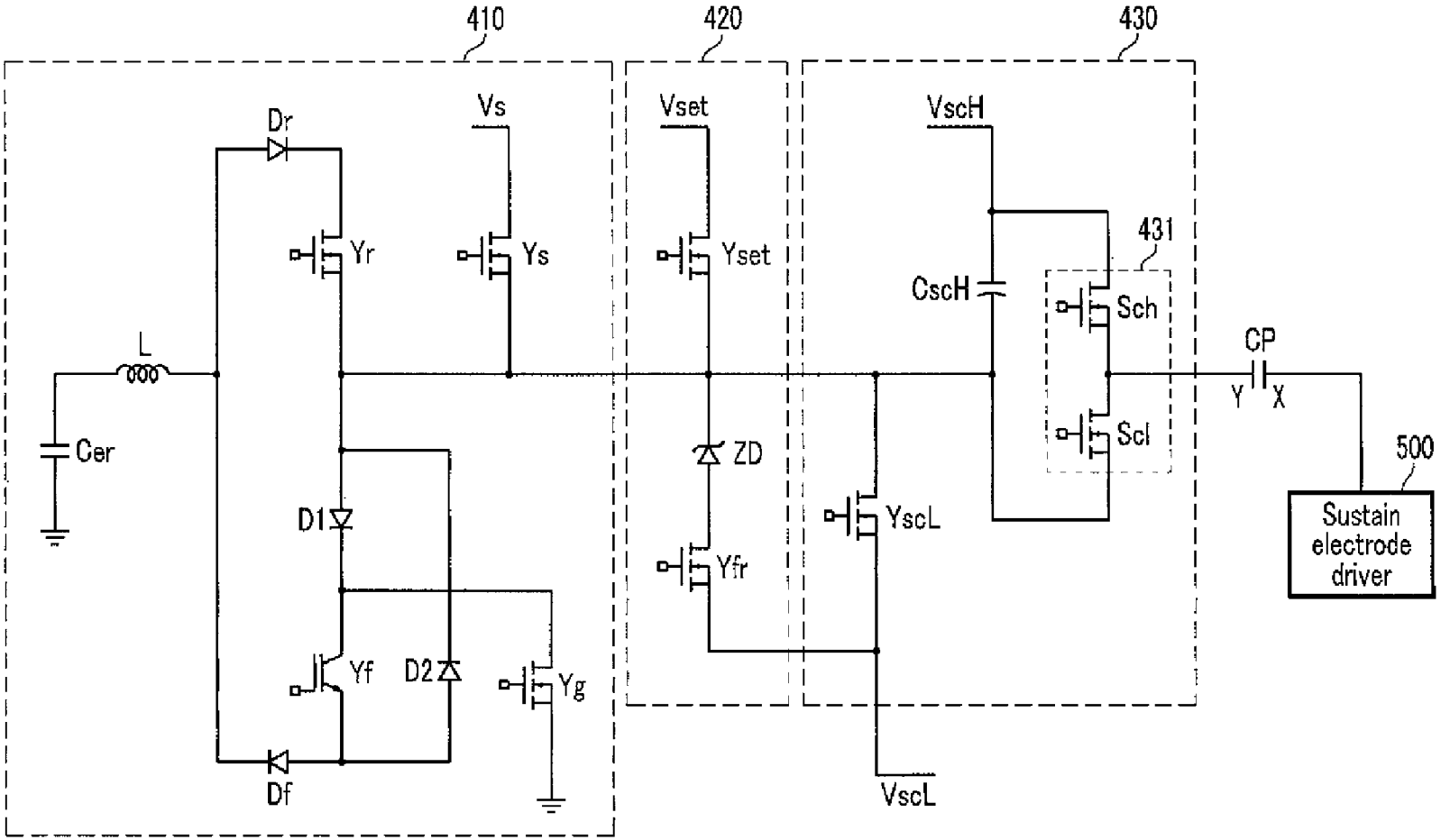
FIG. 3 is a drawing showing a driving circuit of the scan electrode driver according to an exemplary embodiment.

A driving circuit for applying the driving waveform shown in FIG. 2 will be described with reference to FIG. 3. In FIG. 3, transistors Sch, Scl, Yset, YscL, Yfr, Ys, Yg, and Yr are n-channel field effect transistors. Particularly, the transistors Sch, Scl, Yset, YscL, Yfr, Ys, Yg and Yr are n-channel metal oxide semiconductor (NMOS) transistors and the transistor Yf is an n-channel insulated gate bipolar transistor (IGBT). Other embodiments, however, may use other arrangements. Body diodes may be formed in a direction from a source to a drain for at least some of the transistors, for example, for Sch, Scl, Yset, YscL, Yfr, Ys, and Yg. Further, the body diodes may be formed in a direction from an emitter to a collector of the transistor Yf. Instead of the NMOS transistors and the IGBT transistor, transistors of other channels or other types may be used as transistors Sch, Scl, Yset, YscL, Yfr, Ys, Yg, Yr, and Yf. Although each of the transistors Sch, Scl, Yset, YscL, Yfr, Ys, Yg, Yr, and Yf are shown as one transistor, each of the transistors Sch, Scl, Yset, YscL, Yfr, Ys, Yg, Yr, and Yf may be formed of a plurality of transistors coupled in parallel. Further, FIG. 3 shows only a single Y electrode and a capacitance component formed by the single Y electrode and a single X electrode is shown as a panel capacitor Cp.

FIG. 3 is a schematic drawing showing a driving circuit of the scan electrode driver according to an exemplary embodiment.

As shown in FIG. 3, the scan electrode driver 400 includes a sustain driver 410, a reset driver 420, and a scan driver 430.

The scan driver 430 includes a scan circuit 431, a capacitor CscH, and a transistor YscL. The scan driver 430 sequentialy applies the scan voltage VscL to the plurality of Y electrode, and applies the voltage VscH to the scan electrode to which the voltage VscL has been applied during the address period. The scan circuit 431 includes a high side terminal and a low side terminal, and an output terminal. The output terminal is connected with the Y electrode. In order to select light-emitting cells during the address period, the voltage of the high side terminal and voltage of the low side terminal are selectively applied to the corresponding Y electrode. In FIG. 3, although it is shown that the single scan circuit 431 is connected with the Y electrode, actually, the scan circuit 431 is connected with the plurality of Y electrodes (Y1-Yn in FIG. 1). In addition, a certain number of scan circuits 431 can be formed as a single IC and a plurality of output terminals of the IC may be connected with a certain number of Y electrodes (e.g., Y1-Yk wherein 'k' is an integer smaller than 'n').

Scan circuit 431 further includes transistors Sch and Scl. A source of the transistor Sch and a drain of the transistor Scl are connected to Y electrode through the output of the scan circuit 431. A source of the transistor Scl is connected to a first terminal of the capacitor CscH through the low side terminal, and a drain of the transistor Sch is connected to a second terminal of the capacitor CscH through the high side terminal. A source of the transistor YscL is connected to a power source for supplying the scan voltage VscL, and a drain of the transistor YscL is connected to the source of the transistor Scl through the low side terminal of the scan circuit 431. Further, the second terminal of the capacitor CscH is connected to a power source for supplying the voltage VscH, and a diode (not shown) may be connected between the power source for supplying the voltage VscH and the second terminal of the capacitor CscH in order to cut off a current path formed from the capacitor CscH to the power source for supplying the voltage VscH. When the transistor YscL is turned on, the voltage (VscH−VscL) is charged in the capacitor CscH.

The sustain driver 410 includes a power recovery capacitor Cer, an inductor L, diodes D1 and D2, and transistors Yr, Yf, Ys, and Yg.

A first terminal of the inductor L is connected to a drain of the transistor Yr through diode Dr and to an emitter of the transistor Yf through diode Df, and a second terminal of the inductor L is connected to a first terminal of the power recovery capacitor Cer. A second terminal of the power recovery capacitor Cer is connected to the ground terminal. An anode of the diode D2 is connected to the emitter of the transistor Yf and a cathode of the diode D2 is connected to an anode of the diode D1. Further, the cathode of the diode D2 is connected to the low side terminal of the scan circuit 431. A cathode of the diode D1 is connected to a collector of the transistor Yf, and the anode of the diode D1 is connected to the low side terminal of the scan circuit 431. A drain of the transistor Ys is connected to a power source for supplying the voltage Vs, and a source of the transistor Ys is connected to the low side terminal of the scan circuit 431. A drain of the transistor Yg is connected to the cathode of the diode D1 and the collector of the transistor Yf, and a source of the transistor Yg is connected to the ground terminal.

The diode D1 may set a current path formed from the panel capacitor Cp to the transistor Yg, and may cut off a current path from the transistor Yg to the transistor YscL. Because the scan voltage VscL applied through the transistor YscL is lower than the 0V voltage, when the transistor YscL is turned on, if it was not for the diode D1, a current path from the ground terminal, a body diode of the transistor Yg, the transistor YscL, and the power source may be formed. Since the diode D1 cuts off that current path, a transistor of a high cost is not used. The diode D2 allows a current path from the transistor Yg through the transistor Yf when the transistor Yf is turned on.

According to this exemplary embodiment, when the transistor YscL for applying the scan voltage of the negative voltage is turned on, the current path between the ground terminal and the power source for supplying the scan voltage VscL through the body diode of the transistor Yg and the transistor YscL may not be formed.

A diode comprising the body diode of the transistor Yg may be used as the diode D1. Since the diode D2 flows current only through the transistor Xf, a diode comprising the body diode of the transistor Xf may be used as the diode D2.

Meanwhile, although the transistors Yr and Yf have a body diode, the sustain driver 410 further includes diodes Dr and Df. A cathode of the diode Dr is connected to the drain of the transistor Yr, and an anode of the diode Dr is connected to the first terminal of the inductor L. An anode of the diode Df is connected to the emitter of the transistor Yf, and a cathode of the diode Df is connected to the first terminal of the inductor L. The diode Dr cuts off a current path that may otherwise be formed through the body diode of the transistor Yr, and the diode Df cuts off a current path that may otherwise be formed through the body diode of the transistor Yf. In some embodiments, the transistors Yr and Yf do not have body diodes, and the diodes Dr and Df are not used.

The sustain driver 411 gradually increases the voltage of the Y electrode using a resonance generated between the inductor L and the panel capacitor Cp, and then applies the voltage Vs to the Y electrode, and gradually decreases the voltage of the Y electrode using a resonance generated between the inductor L and the panel capacitor Cp and then applies the voltage 0V to the Y electrode.

Further, unlike in FIG. 3, in some embodiments, the first terminal of the inductor L may be connected to the low side terminal of the scan circuit 431, and the second terminal of the inductor L may be connected to the diode D1 and the transistor Yr. In addition, unlike in FIG. 3, in some embodiments, the sustain driver 410 may include a plurality of inductors. For example, one inductor (not shown) may be formed in the path formed by the power recovery capacitor Cer, the diode Dr, the transistor Yr, and the panel capacitor Cp, and another inductor (not shown) may be formed in the path formed by the panel capacitor Cp, the diode D1, the transistor Yf, the diode Df, and the power recovery capacitor Cer.

The reset driver 420 includes transistors Yset and Yfr, and a zener diode ZD. The reset driver 420 gradually increases the voltage of the Y electrode from the voltage Vs to the voltage Vset during the rising period of the reset period, and gradually decreases the voltage of the Y electrode from the voltage Vs to the voltage Vnf during the falling period of the reset period. A drain of the transistor Yset is connected to a power source for supplying the voltage Vset, and a source of the transistor Yset is connected to the Y electrode through the low side terminal of the scan circuit 431. When the transistor Yset is turned on, a small current flows from its drain to its source to allow the voltage of the Y electrode to be gradually increased in a ramp pattern to the voltage Vset.

A diode (not shown) may be formed in an opposite direction to the body diode of the transistor Yset to cut off a current by the body diode.

The transistor Yfr and the zener diode ZD are connected in series between the power source for supplying the voltage VscL and the low side terminal of the scan circuit 431. When the transistor Yfr is turned on, a small current flows from its drain to its source to allow the voltage of the Y electrode to be gradually decreased in the ramp pattern to the voltage Vnf corresponding to the sum of a breakdown voltage of the zener diode ZD and the voltage VscL. In some embodiments, the transistor Yfr may be connected between the power source for supplying the voltage Vnf and the low side terminal of the scan circuit 431 without the zener diode ZD.

Figure 5:
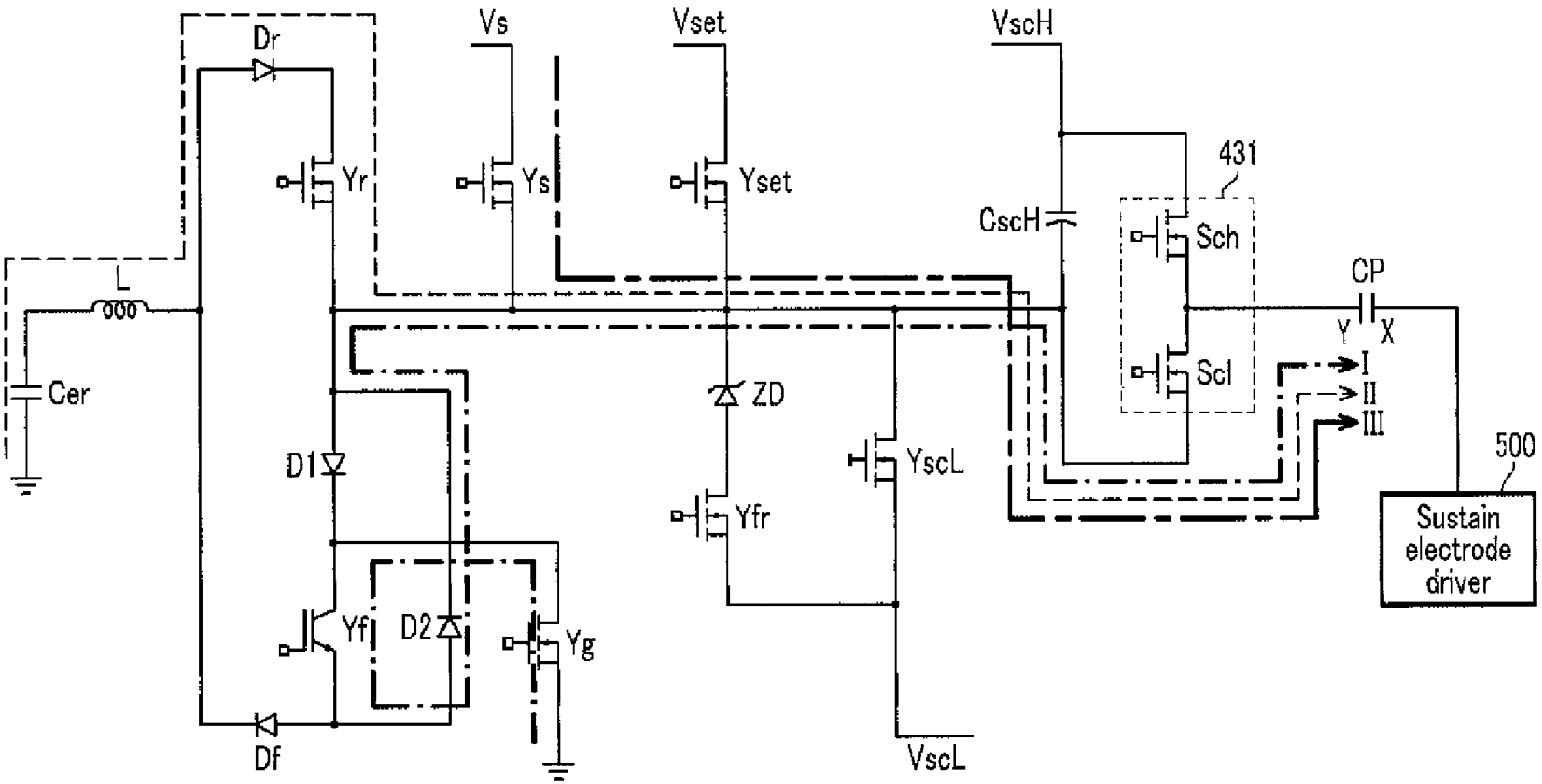
FIG. 5 and FIG. 6 are drawings showing a current path according to the signal timing shown in FIG. 4, respectively.
Figure 6:
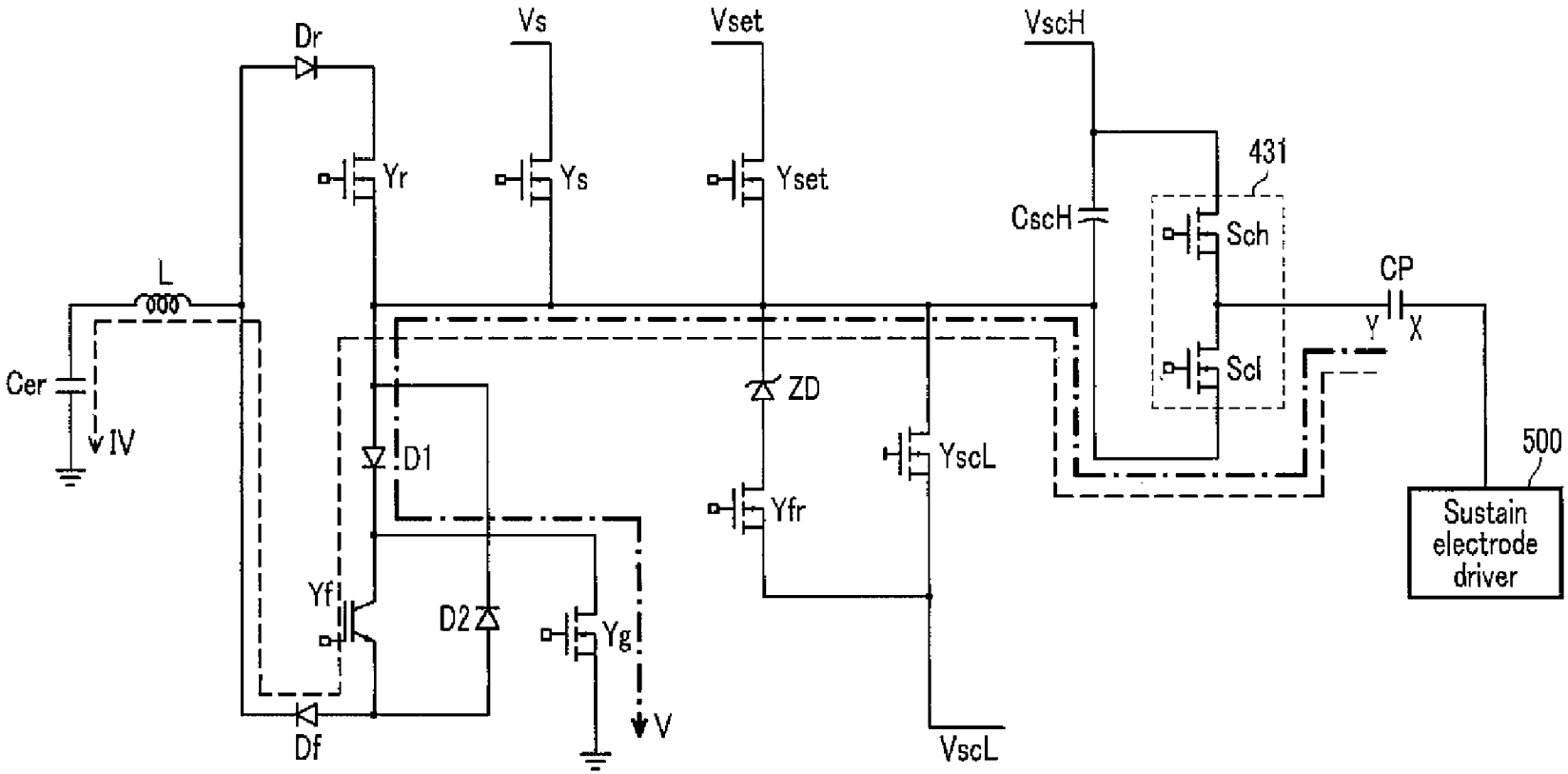

A method for applying the driving waveform shown in FIG. 2 using the driving circuit of FIG. 3 will now be described with reference to FIGS. 4 to 6. Particularly, a method for applying the driving waveform of a portion of the address period and the sustain period will be described.

Figure 4:
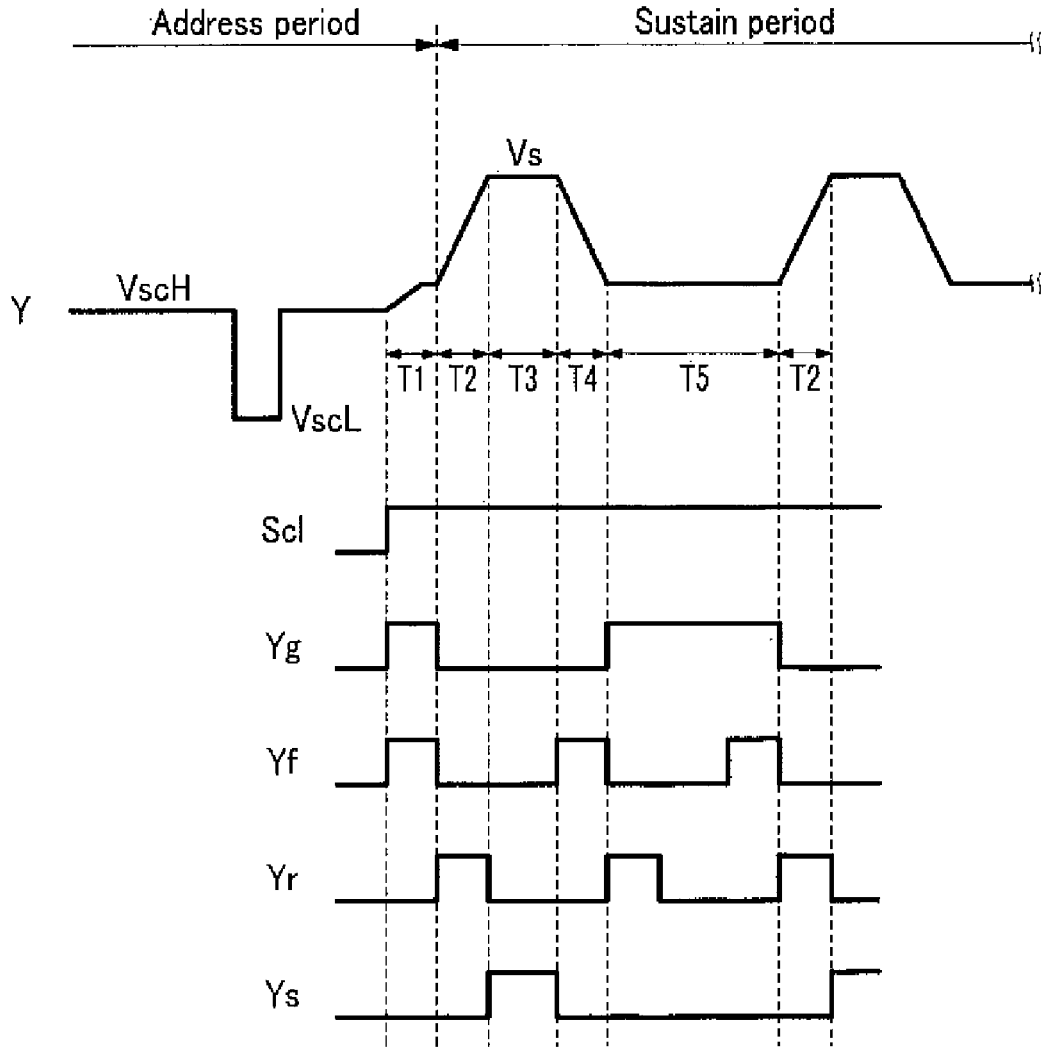
FIG. 4 is a drawing showing signal timing in an address period and a sustain period among the driving waveform shown in FIG. 2.

FIG. 4 is a schematic drawing showing signal timing in an address period and a sustain period of the driving waveform shown in FIG. 2. FIGS. 5 and 6 are schematic drawings showing current paths according to the signal timing shown in FIG. 4.

Before a period T1, the transistor Sch is turned on and the voltage of the Y electrode is maintained as the voltage VscH.

As shown in FIG. 4, during period T1, while the transistor Sch is turned off and the transistor Scl is turned on, the transistors Yg and Yf are turned on. Then, as shown in FIG. 5, a current path I is formed through the ground terminal, the transistors Yg and Yf, the diode D2, the transistor Scl, and the Y electrode of the panel capacitor Cp. The voltage 0V is applied to the Y electrode by the current path I.

FIG. 2 and FIG. 4 show the period T1 as the address period, and the period T1 may be a period between the address period and the sustain period, or the sustain period may include the period T1.

Next, in a period T2, the transistor Yr is turned on, and the transistors Yg and Yf are turned off. Then, as shown in FIG. 5, a current path II is formed through the power recovery capacitor Cer, the inductor L, the diode Dr, the transistors Yr, the transistor Scl, and the Y electrode of the panel capacitor Cp. The resonance is generated between the inductor L and the panel capacitor Cp by the current path II.

Since the voltage Vs/2 is charged to the capacitor Cer, the voltage of the Y electrode is gradually increased to a voltage that is close to the voltage Vs.

In a period T3, the transistor Ys is turned on, and the transistor Yr is turned off. Then, as shown in FIG. 5, a current path III is formed through the power source Vs, the transistor Scl, and the Y electrode of the panel capacitor Cp. The voltage Vs is applied to the Y electrode by the current path III. Further, in the period T3, the sustain electrode driver 500 may apply the voltage 0V to the X electrode.

In a period T4, the transistor Yf is turned on, and the transistor Ys is turned off. Then, as shown in FIG. 6, a current path IV is formed through the Y electrode of the panel capacitor Cp, the transistor Scl, the diode D1, the transistor Yf, the diode Df, the inductor L, and the power recovery capacitor. The resonance is generated between the inductor L and the panel capacitor Cp by the current path IV. As a result, the voltage of the Y electrode is gradually decreased to a voltage that is close to the voltage 0V while the voltage charged to the capacitor Cer is discharged to the power recovery capacitor Cer.

In a period T5, the transistor Yg is turned on, and the transistor Yf is turned off. Then, as shown in FIG. 6, a current path V is formed through the Y electrode of the panel capacitor Cp, the transistor Scl, the diode D1, the transistor Yg, and ground terminal. 0V is applied to the Y electrode by the path V. Meanwhile, the sustain electrode driver 500 may apply the voltage Vs to the X electrode in the period T5. The sustain electrode driver 500 may alternately apply 0V and the voltage Vs to the Y electrode by repeating the operations of the periods T2 to T5 as many times as a number corresponding to a weight value of the current subfield.

While this invention has been described in connection with what is presently considered to be practical exemplary embodiments, it is to be understood that the invention is not limited to the disclosed embodiments, but, on the contrary, is intended to cover various modifications and equivalent arrangements.

What is claimed is:

1. A driving apparatus configured to drive a plasma display device including scan electrode, the apparatus comprising:

a first switch connected between a first power source and the scan electrode, wherein the first power source is configured to supply a first voltage;

a first diode and a second switch connected in series between a second power source and the scan electrode, wherein the second power source is configured to supply a second voltage, second voltage being higher than the first voltage;

a third switch connected between a power recovery capacitor and a contact point between the first diode and the second switch, wherein the third switch is directly connected to the contact point; and a second diode connected in parallel with the first diode and the third switch.

2. The driving apparatus of claim 1, wherein a cathode of the first diode is connected to a first terminal of the third switch, a second terminal of the third switch is connected to an anode of the second diode, and a cathode of the second diode is connected to an anode of the first diode.

3. The driving apparatus of claim 1, wherein the first switch is configured to be turned on to apply the first voltage to the scan electrode during an address period.

4. The driving apparatus of claim 1, wherein the second switch and the third switch are configured to be turned on to apply the second voltage to the scan electrode near the transition from an address period to a sustain period.

5. The driving apparatus of claim 1, wherein the third switch is configured to be turned on to decrease a voltage at the scan electrode before the second switch is turned on to apply the second voltage to the scan electrode during a sustain period.

6. The driving apparatus of claim 1, further comprising:

an inductor connected between the power recovery capacitor and the third switch.

7. The driving apparatus of claim 1, further comprising:

a fourth switch connected between a third power source and the scan electrode, wherein the third power source is configured to supply a third voltage, the third voltage being higher than the second voltage; and a fifth switch connected between the scan electrode and the power recovery capacitor.

8. A plasma display comprising:

a scan electrode;

a first switch connected between a first power source and the scan electrode, wherein the first power source is configured to supply a scan voltage; and a sustain driver connected to the scan electrode, wherein the sustain driver is configured to alternately apply a low level voltage that is higher than the scan voltage and a high level voltage that is higher than the low level voltage to the scan electrode during a sustain period, wherein the sustain driver includes:

a second switch having a first terminal connected to a second power source, wherein the second power source is configured to supply the low level voltage;

a first current path between the scan electrode and a second terminal of the second switch, wherein the second switch is configured to cut off a current formed form the second terminal of the second switch to the scan electrode;

a third switch connected between the first current path and a power recovery capacitor, wherein when turned on a voltage of the scan electrode is decreased through the first current path; and a second current path from the second terminal of the second switch to the scan electrode, the second current path being different from the first current path, wherein the first current path includes a first diode connected between the scan electrode and the second terminal of the second switch.

9. The plasma display of claim 8, wherein:

a first terminal of the third switch is connected to a contact point on the first current path and connected to the second switch;

the second current path includes a second terminal of the third switch and the scan electrode; and the current flow from the second terminal of the second switch to the scan electrode passes through the third switch and the second current path.

10. The plasma display of claim 8, wherein the second current path includes a first diode connected between the second terminal of the third switch and the scan electrode.

11. The plasma display of claim 8, wherein the sustain driver includes an inductor connected between the third switch and the power recovery capacitor.

12. The plasma display of claim 8, wherein the second switch and the third switch are configured to be turned on to apply the low level voltage to the scan electrode near the transition from an address period to the sustain period.

13. The plasma display of claim 8, wherein the third switch is configured to be turned on to decrease a voltage of the scan electrode before the second switch is turned on to apply the low level voltage to the scan electrode in the sustain period.

14. A driving apparatus configured to drive a scan electrode of a plasma display device, the apparatus comprising:

a first switch configured to supply the scan electrode with a supply voltage through either of first and second current paths, the first current path configured to conduct current from the scan electrode and the second current path configured to conduct current to the scan electrode;

a second switch;

a first diode in the first current path; and a second diode in the second current path, wherein a cathode of the first diode is connected to a first terminal of the second switch, a second terminal of the second switch is connected to an anode of the second diode, and a cathode of the second diode is connected to an anode of the first diode.

15. The driving apparatus of claim 14, wherein the second current path further comprises the second switch connected between the first switch and the second diode.

16. The driving apparatus of claim 15, wherein each of the first and second current paths further comprise a third switch.

17. The driving apparatus of claim 14, wherein the anode of the first diode is connected to the cathode of the second diode.

18. The driving apparatus of claim 14, wherein the second switch is configured to be turned on to apply a first voltage to the scan electrode near the transition from an address period to a sustain period.

* * * * *